United States Patent [19]

Klein

[11] 4,394,633

[45] Jul. 19, 1983

[54] MICROSTRIP CIRCUIT WITH SUSPENDED SUBSTRATE STRIPLINE REGIONS EMBEDDED THEREIN

[75] Inventor: Gerald I. Klein, Baltimore, Md.

[73] Assignee: Westinghouse Electric Corp., Pittsburgh, Pa.

[21] Appl. No.: 258,349

[22] Filed: Apr. 28, 1981

[51] Int. Cl.[3] ..... H01P 3/08

[52] U.S. Cl. ..... 333/238; 333/246

[58] Field of Search ..... 333/238, 246, 204, 222; 331/96, 107 SL

[56] References Cited

U.S. PATENT DOCUMENTS 4,131,894 12/1978 Schiavone ..... 333/246 X 4,281,302 7/1981 Stegens ..... 333/246 X

*Primary Examiner*—Paul L. Gensler

*Attorney, Agent, or Firm*—W. E. Zitelli

[57] ABSTRACT

A microstrip microwave circuit having embedded therein at least one suspended substrate stripline region for high Q circuit elements is disclosed. Each suspended substrate region includes an upper ground plane formed by covering the microstrip circuitry of each region with a metallic housing having holes in the sidewalls thereof to permit passage therethrough for the interconnecting circuit paths of the region and by connecting the housing to the top surface of the microstrip ground plane substrate; and a lower ground plane formed by removing the section of substrate lying substantially underneath each high Q region to form openings in the bottom surface of the substrate which are covered by an individual cover plate. The upper and lower ground planes are separated from their corresponding high Q regions by an air spacing dimensioned as a function of the RF impedance desired. Also disclosed herein is a method of making the microstrip microwave circuit including the steps of embedding the least one suspended substrate stripline region for high Q circuit elements therein.

11 Claims, 10 Drawing Figures

MICROSTRIP CIRCUIT WITH SUSPENDED SUBSTRATE STRIPLINE REGIONS EMBEDDED THEREIN

BACKGROUND OF THE INVENTION

The present invention relates to microwave hybrid integrated circuits in general, and more particularly, to an integral ground plane soft-dielectric substrate microstrip circuit locally modified to embed at least one suspended substrate stripline region for high Q circuit elements and a method for making the same.

From a manufacturing cost view point, it is well recognized that microstrip technology appears to be the optimum in the implementation of a large class of microwave circuits. The primary advantage in the manufacturing process of microstrip is the use of a one step photolithographic technique for preparing continuously the various microstrip circuits over a large surface area. However, since the microstrip circuit is an open circuit, that is elements like transistors, chip capacitors, chip resistors, . . . , etc., for example, can be assembled on the top of the printed circuit region, it is an unbalanced microwave circuit and therefore, exhibits low Q levels, on the order of 100–200, for example.

Another form of microwave circuit implementation, generally referred to as stripline, includes a stripline printed circuit sandwiched between two solid thick dielectric layers which inturn are sandwiched between two ground planes resulting in a three conductor system. An example of this strip line form can be found under the trade name "Triplate" manufactured by Sanders Associates. While achieving a higher Q level, say on the order of 400, for example, the stripline structure is limited in going any higher because of the solid dielectric filling between the printed circuit conductor and ground planes.

One way of increasing the Q levels of the stripline implementation of microwave circuit is to eliminate or reduce the solid dielectric filling which leads to a microwave circuit structure having a thin layer of dielectric supported in air between two supporting structures and a stripline microwave circuit formed on the dielectric layer. In this structure, two ground planes are supported on top and below the microwave conductor pattern formed on the dielectric. The air spacing between the ground planes and the printed circuit pattern above and below is much greater than the dielectric thickness. This configuration is commonly referred to as suspended substrate stripline and may achieve Q levels on the order of 500–1000, for example.

The problem which presents itself in many microwave circuits is the need for only a few relatively small regions of the overall microwave circuit that may include only one or two circuit elements with very high Q circuit requirements. For example, in a low noise microwave oscillator/buffer amplifier circuit, only one resonator in the oscillator circuit requires high Q levels to maintain low noise output. When the dielectric constant and thickness of the dielectric layer are selected solely to satisfy this criteria for the critical application, the remainder of the microwave circuitry suffers somewhat from this undesirable compromise. For example, the use of dielectric thickness in excess of 0.025 inches to improve the Q levels often introduces problems with reliability in groun connections due to thermal expansion stresses. Apparently, it is not only the technology to achieve greater Q levels in the microwave circuits which is needed, but also a way of interfacing the various technologies to achieve the performance of high Q elements in one medium and lower Q elements in another while maintaining the overall advantages of both.

Generally, when it is determined economically attractive, the entire microwave circuitry may be implemented with microstrip technology except for those regions which required high Q levels. For these regions, the microstrip circuitry may be terminated and the remaining high Q circuitry built in a different medium like coaxial section, for example. The two regions may then be physically connected together with connectors, screws or other mechanical devices for structural support. This interconnection of microstrip with coaxial or microstrip with other types of high Q mediums generally results in a real discontinuity in current flow. Not only do these mechanical type interconnections render a high manufacturing cost, but they also include a number of structural and fabricational disadvantages.

Therefore, for those microstrip microwave circuits which include resonators and filters requiring another medium to support a higher unloaded Q than can normally be provided in the microstrip medium, it is of paramount importance to maintain a structural integrity for RF current flow continuity between the high and low Q mediums while achieving an integralness in the fabricational process to reduce the high cost of manufacturing and alleviate the mechanical problems associated with interfacing the different microwave circuit mediums.

SUMMARY OF THE INVENTION

In accordance with the principles of the present invention, a microstrip microwave circuit has embedded therein at least one suspended substrate stripline region for high Q circuit elements. The microwave circuit includes a dielectric substrate layer disposed on the top surface of a ground plane. A continuous microstrip circuit pattern is disposed on the exposed surface of the dielectric layer and has at least one region for high Q circuit elements with at least one interconnecting circuit path to the remaining microstrip circuitry. The ground plane has the section substantially underneath each high Q region removed to form openings in the bottom surface thereof. A metallic housing is provided for each high Q region to form an upper ground plane covering the corresponding microstrip circuitry and separated therefrom by an air pocket. Each housing has sidewalls adapted for making physical contact with the top surface of the ground plane. The sidewalls of each housing include an opening for each interconnecting microstrip circuit path for passage therethrough. Further provided is a metallic cover for the openings in the bottom surface of the ground plane to form a lower ground plane for each high Q region, the cover being separated from the microstrip circuitry of each high Q region by the dielectric layer and an air pocket.

In one embodiment, the dielectric layer has channels through to the top surface of the ground plane substantially encircling the microstrip circuitry of each of the corresponding high Q regions except for portions of the dielectric layer which support the interconnecting microstrip circuit paths thereof. Accordingly, in this embodiment, the sidewalls of each housing are adapted for seating into the dielectric channels of its high Q region to make physical contact with the top surface of the ground plane.

The invention further includes a method of making the microstrip microwave circuit with the suspended substrate stripline regions embedded therein. The method steps include disposing a dielectric layer on the top surface of a ground plane, forming a continuous microstrip circuit pattern on the exposed surface of the dielectric layer with at least one region for high Q circuit elements having at least one interconnecting circuit path to the remaining microstrip circuitry, removing the section of the ground plane which resides substantially underneath each high Q region to form openings in the bottom surface of the ground plane, covering the microstrip circuitry of each high Q region with a metallic housing to form an upper ground plane separated correspondingly from a high Q region by an air pocket, providing an opening in each metallic housing for each connecting path from the corresponding high Q region being covered to permit passage therethrough, connecting each metallic housing to the ground plane, and enclosing each opening of the bottom surface of the ground plane with a metallic cover to form a lower ground plane separated from each high Q region by the dielectric layer thickness and a pocket of air, whereby each high Q region has an upper and lower ground plane separated from the microstrip circuitry and dielectric layer thereof by air, which formation constitutes a suspended substrate strip line region.

DESCRIPTION OF THE PREFERRED EMBODIMENT

Figure 1A:
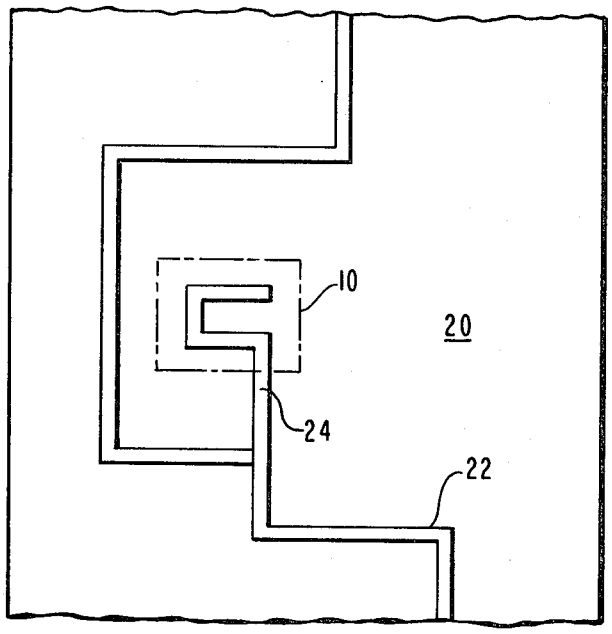
FIGS. 1A and 1B depict illustratively a portion of an exemplary microstrip microwave circuit in a plan view and a cross-sectional view, respectively.
Figure 1B:
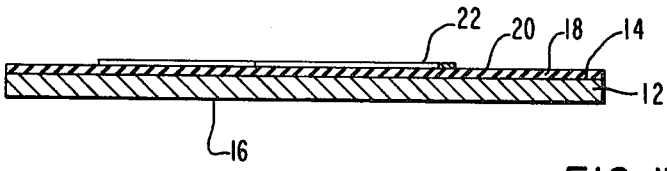

FIGS. 1A and 1B depict illustratively a portion of an exemplary microstrip microwave circuit in a plan view and a cross-sectional view, respectively. The microstrip circuit includes at least one region 10 for high Q circuit elements, like a resonator or filter section, for example. More specifically, the microstrip circuit comprises a ground plane 12 having a top surface 14 and bottom surface 16. Typically, the ground plane 12 may comprise an aluminum sheet on the order of 1/16 to ¼ inches in thickness. Disposed on the top surface 14 is a soft-dielectric layer 18 which may typically have a thickness of 0.005 to 0.1 inches. Disposed on the exposed surface 20 of the dielectric layer 18 is a continuous microstrip circuit pattern 22 having at least one region 10 for high Q circuit elements with at least one interconnecting circuit path 24. In accordance with the principles of the present invention, each of the high Q regions 10 may be converted into a suspended substrate stripline region to achieve the required high Q circuit characteristics.

Figure 2:
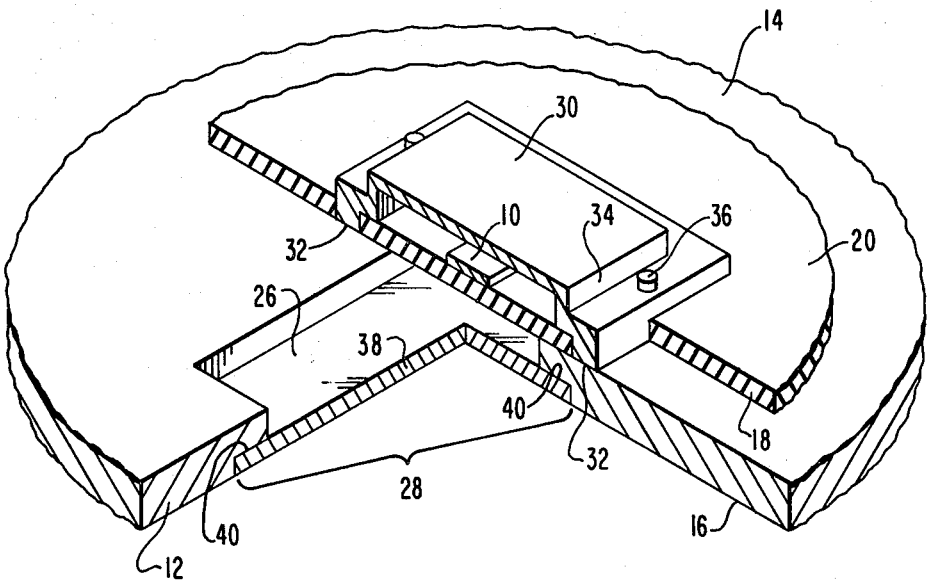
FIG. 2 is a cut-away cross-sectional isometric view of an embodiment suitable for use in describing applicant's inventive principles.

FIG. 2 is a cut-away cross-sectional isometric view of an embodiment suitable for use in describing applicant's inventive principles. In accordance with this embodiment, a section 26 of the ground plane 12 lying substantially underneath the high Q region 10 may be removed to form an opening 28 in the bottom surface 16 thereof. A metallic housing 30 may be provided for each high Q region 10 and connected to the ground plane 12 to form an upper ground plane covering the corresponding microstrip circuitry thereof. For example, in the present embodiment, the dielectric layer 18 may have channels 32 cut through to the top surface 14 of the ground plane 12 substantially encircling each high Q region 10. Moreover, each housing 30 may have sidewalls 34 which are adapted for seating into the dielectric channels 32 of its corresponding high Q region 10 to make physical contact with the top surface 14 of the ground plane 12. The housing 30 may be secured into position by solder or conductive epoxy or using bolts 36, such as that shown in FIG. 2, for example.

While the sidewalls 34 of the housings 30 in the present embodiment are shown as solid, it is understood by those skilled in the pertinent art that they need not be limited as such. For example, sidewalls which comprises pins or stakes spaced apart and supporting a top plate may constitute another suitable embodiment. In these cases, the pins or stakes making up the grated sidewalls may be connected to the ground plane 12 through corresponding holes in the dielectric layer 18 and ground plane 12. The spacings of the pins or stakes are made suitably small on the order of $1/10\lambda$, for example, in order to provide adequate shielding.

Still further, a metallic cover may be provided for each opening 28 of the ground plane substrate 12 to form a lower ground plane for each high Q region 10. In the present embodiment, the metallic cover includes an individual cover plate 38 for each opening 28 in the bottom substrate 16. The cover plate 38 may be of a thickness t substantially less than that of the thickness T of the substrate 12. The plate may also be of a cross-sectional area to conform with the opening 28 corresponding thereto. Furthermore, each opening 28 at the bottom substrate surface 16 may be contoured to form a seat 40 around the periphery thereof to accommodate the individual cover plate associated therewith.

Each of the formed upper and lower ground planes for the high Q region 10 may be dimensioned to provide an air separation or air pocket between the walls thereof and the microstrip circuitry being enclosed. Generally, this air separation is based on the RF impedance desired for the corresponding high Q region 10.

Figure 3:
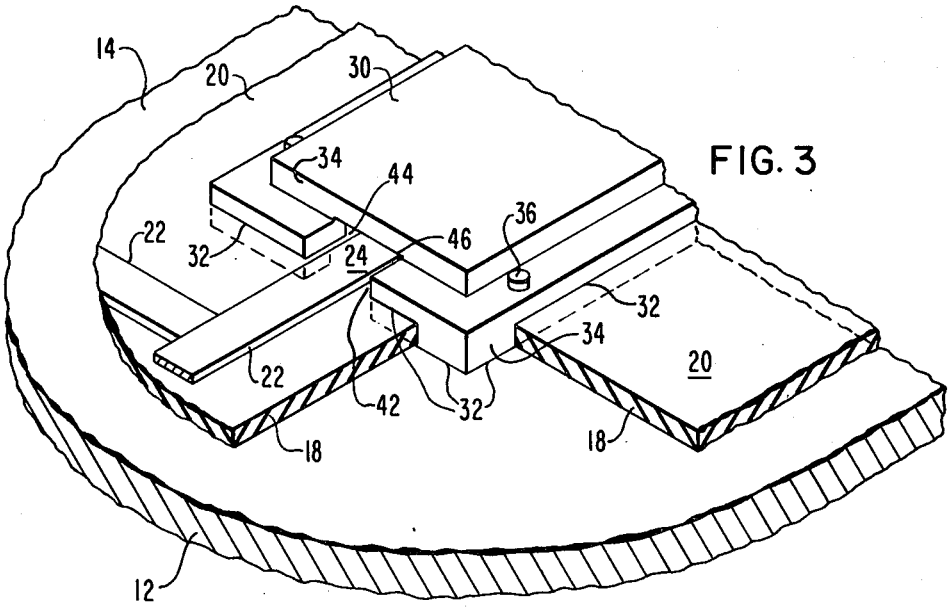
FIG. 3 is a cut-away cross-sectional isometric depiction of another view of the embodiment to illustrate another aspect of the present invention.

FIG. 3 is a cut-away, cross-section, isometric depiction of another view of the embodiment to illustrate another aspect of the present invention. In this illustrative view, the channels 32 of the dielectric layer 18 correspondingly encircle each of the high Q regions 10 of the overall microstrip circuitry 22 except for portions 42 of the dielectric layer 18 which support the interconnecting microstrip circuit paths 24 thereof. An opening 44 may be provided in the sidewalls 34 of each housing 30 and contoured to conform substantially with the dielectric portions 42 supporting the interconnecting paths 24 correspondingly thereto. The periphery 46 of each opening 44 may be dimensioned such that its air separation from the corresponding interconnecting circuit path 24 provides the shielding desired for the enclosed high Q region 10.

Figure 4:
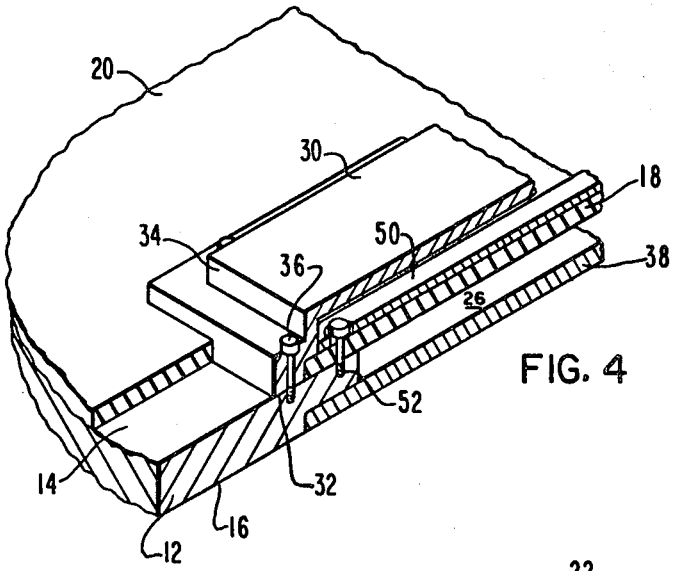
FIG. 4 depicts still another cut-away cross-sectional isometric view of the present embodiment.
Figure 5A:
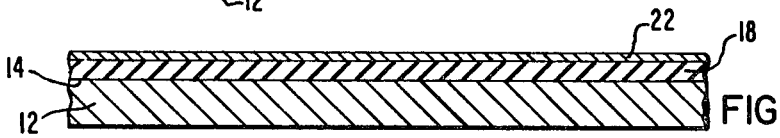
FIG. 5 illustratively depicts cross-sectional views 5A through 5E of the present embodiment for use in describing a method of making the same.
Figure 5B:
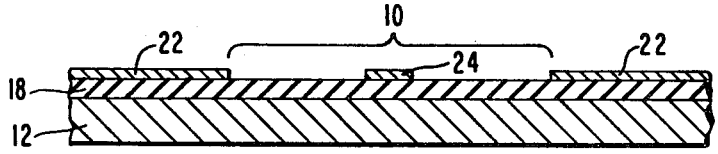
Figure 5C:
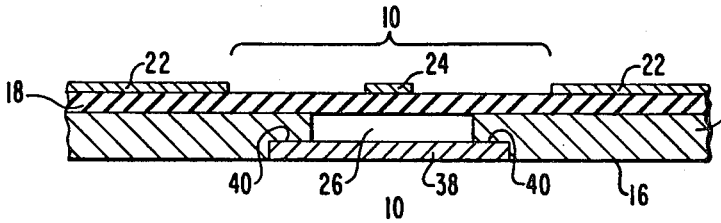
Figure 5D:
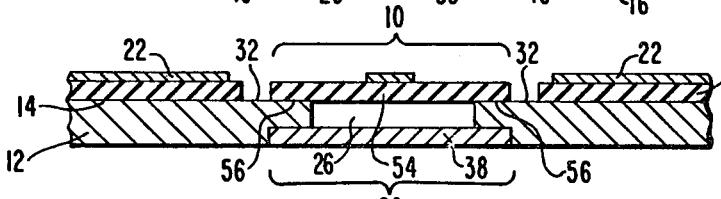
Figure 5E:
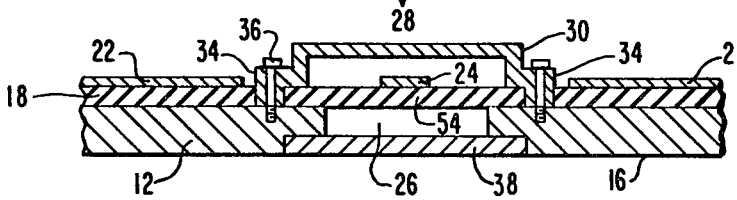

FIG. 4 depicts still another cut away cross-sectional isometric view of the embodiment. In some cases, like for a resonator, for example, a microstrip circuit path 50 in the high Q region 10 may be terminated to the ground plane. This may be accomplished in the present embodiment as shown in the view of FIG. 4, by including a pin 52 down through the circuit path 50, dielectric layer 18, and into the ground plane substrate 12. To secure the pin 52 in place, it may be soldered, for example, to the circuit path 50. The connection provided with the pin 52 provides a reliable short circuit to the lower ground plane and in addition, an offset short circuit to the upper ground plane of the housing 30.

It is understood that while only one high Q region having a suspended substrate stripline formation is shown by the views of FIGS. 2 through 4, there may be two, three or even more of these high Q regions in a very large integral continuous microstrip circuit pattern. In each case, the structure of the suspended substrate strip line region will be the same as that depicted in the FIGS. of 2 through 4. In fact, the present invention may even include intermediate shielded or grounded sections with one housing being enclosed within another housing if the application necessitates such a structure.

It is further understood that while only one opening is shown in the sidewalls of the housing 30 for the present embodiment (see FIG. 3), the metallic housing may include as many openings as there are interconnecting paths in the high Q region which it is covering. For example, when the high Q region is a filter section, there may be two or even three interconnecting circuit paths, in which case, there would be needed two or even three corresponding openings in the sidewalls of the metallic housing. Accordingly, each opening of the housing 30 is closed off adequately to a small aperture to prevent radiation between the microwave signals of the different Q regions.

A method of making the microstrip microwave circuit having embedded therein at least one suspended substrate stripline region for high Q circuit elements is illustratively depicted by the cross-sectional views 5A through 5E of FIG. 5. As shown in view 5A, the process may start with a standard microstrip circuit formation building block in which a dielectric layer 18 is bonded to the top surface 14 of a thick ground plane substrate 12 with the exposed surface of the dielectric layer 18 having bonded thereto a sheet of conductive material 22. Next, as shown in view 5B, a continuous circuit pattern is formed from the conductive material 22 using conventional photolithographic techniques, for example. The continuous circuit pattern formed includes at least one region 10 for high Q circuit elements having at least one interconnecting circuit path 24.

As shown in view 5C, a section 26 of the ground plane substrate 12 residing substantially underneath each high Q region 10 is removed to form openings 28 in the bottom surface 16 of the substrate 12. The removal of the metal substrate 12 may be achieved by machining away the metal substantially under the region 10 in each case. In the present embodiment, a seat 40 is formed, preferably by machining around the periphery of each opening 28 at the bottom substrate 16, to receive an individual cover plate 38 which encloses the opening 28. The individual cover plates 38 may be secured in place by epoxy or solder, for example. The removed section 26 and associated cover plate 38 in each case are dimensioned to form an air separation between walls of the formed lower ground plane and the microstrip circuitry of the corresponding high Q region 10 based on the RF impedance desired.

Another step in the method may include removing portions of the dielectric layer 18 by etching or other conventional methods through to the top surface 14 of the substrate 12 to form channels 32 substantially encircling each high Q region 10 as shown in view 5D. The section 54 of the dielectric layer within the channel boundaries of the high Q region 10 may be left supported by the overlapping regions 56 of the substrate 12 protruding slightly within the boundaries of the high Q region 10. Not shown in view 5D are the unremoved portions of the dielectric layer 18 which support the interconnecting circuit paths 24 such as shown in the view of FIG. 3.

As shown in view 5E, the sidewalls 34 of a metallic housing 30 may be seated into the channels 32 of a high Q region 10 to make physical contact with the top surface 14 of the substrate 12. Not shown in view 5E are the openings in the sidewalls 34 of each of the metallic housings 30. The openings may be contoured to conform substantially with the dielectric portions supporting the interconnecting circuit paths 24. A better view for visualizing this seating arrangement may be found in the cut-away cross-sectional view of FIG. 3. As has been described above, the metallic housing 30 may thereafter be secured in place by bolting the sidewalls 34 thereof with bolts 36 to the substrate 12. Accordingly, the dimensioning of the metallic housing to form an air separation between the walls thereof and the microstrip circuitry covered is primarily based on the RF impedance desired.

Some advantages associated with the present embodiment include having the microstrip circuit pattern integrally formed, by photolithographic techniques, for example, such that both high and low Q regions are continuously interconnected on the same substrate. Thus, there are no breaks or soldering points which may introduce RF discontinuities in the center conductor which can possibly lead to undesirable effects. This smooth and well controlled microwave circuit transition between the microstrip and suspended substrate regions imbedded therein gives one the ability to place high Q circuit elements wherever needed in a large microstrip manufactured circuit. The features of integralness permits the building of a super component microwave assembly with a large number of functions all on one structure without having to cut it apart and form discontinuities in the signal transmission paths thereof when higher Q element regions are added. The present embodiment then enables the retention of all the advantages of the soft dielectric microstrip circuitry which include low cost machining, etching, assembly and high reliability while providing for the inclusion of high Q regions for circuits such as resonators and filters without causing undesirable effects in the circuit structure.

I claim:

1. A microstrip microwave circuit having embedded therein at least one suspended substrate stripline region for high Q circuit elements, said microwave circuit comprising:

a ground plane having top and bottom surfaces;

a dielectric layer disposed on said top surface of said ground plane;

a continuous microstrip circuit pattern disposed on the exposed surface of said dielectric layer and having at least one region for high Q circuit elements with at least one interconnecting circuit path to the remaining microstrip circuitry, said dielectric layer having channels through to the top surface of said ground plane substantially encircling said microstrip circuitry of each corresponding high Q region except for portions of the dielectric layer which support said interconnecting microstrip circuit paths thereof;

said ground plane having the section substantially underneath each high Q region removed to form openings in the bottom surface thereof;

a metallic housing for each high Q region to form an upper ground plane covering the corresponding microstrip circuitry and separated therefrom by an air pocket, each housing having sidewalls adapted for seating into the dielectric channels of its high Q region to make physical contact with the top surface of said ground plane, said sidewalls of each housing including an opening for each interconnecting microstrip circuit path for passage therethrough; and a metallic cover for said openings in the bottom surface of said ground plane to form a lower ground plane for each high Q region, said cover being separated from the microstrip circuitry of each high Q region by said dielectric layer and an air pocket.

2. A microstrip microwave circuit in accordance with claim 1 wherein the openings of the sidewalls of each housing are contoured to conform substantially with the dielectric portions supporting the interconnecting circuit paths corresponding thereto, each opening having the periphery thereof spaced from its corresponding interconnecting circuit path based on the RF shielding desired.

3. A microstrip microwave circuit in accordance with claim 1 wherein the metallic housing is dimensioned to permit as air separation between the walls thereof and the microstrip circuitry it covers based on the RF impedance desired for the corresponding high Q region.

4. A microstrip microwave circuit in accordance with claim 1 wherein the metallic cover includes an individual cover plate for each opening in the bottom surface of the ground plane, each individual cover plate being substantially less in thickness than the ground plane and of a cross-sectional area to conform with the opening corresponding thereto; and wherein each opening at the bottom surface of the ground plane is contoured in the form of a seat around the periphery thereof to accommodate said individual cover plate associated therewith.

5. A microstrip microwave circuit in accordance with claim 4 wherein each removed section of ground plane and associated cover plate are dimensioned to permit an air separation between the walls of the formed lower ground plane and the microstrip circuitry of the corresponding high Q region, the dimensions associated with said air separation being based on the RF impedance desired for the corresponding high Q region.

6. A method of making a microstrip microwave circuit having embedded therein at least one suspended substrate stripline region for high Q circuit elements, said method comprising the steps of:

disposing a dielectric layer on the top surface of a ground plane;

forming a continuous microstrip circuit pattern on the exposed surface of said dielectric layer with at least one region for high Q circuit elements having at least one interconnecting circuit path to the remaining microstrip circuitry;

removing portions of the dielectric layer through to the top surface of the ground plane to form channels substantially encircling each high Q region;

removing the section of said ground plane which resides substantially underneath each high Q region to form openings in the bottom surface of said ground plane;

covering the microstrip circuitry of each high Q region with a metallic housing having sidewalls by seating the sidewalls of each metallic housing in the removed channels of its corresponding high Q region to make physical contact with the top surface of the ground plane to form an upper ground plane separated correspondingly from a high Q region by an air pocket;

providing an opening in each metallic housing for each interconnecting path of the corresponding high Q region being covered to permit passage therethrough; and enclosing each opening of the bottom surface of said ground plane with a metallic cover to form a lower ground plane separated from each high Q region by said dielectric layer thickness and a pocket of air, whereby each high Q region has an upper and lower ground plane separated from the microstrip circuitry and dielectric layer thereof by air which formation constitutes a suspended substrate stripline region.

7. The method in accordance with claim 6 including the steps of:

removing portions of the dielectric layer through to the top surface of the ground plane to form a channel encircling each high Q region except for the portions of dielectric layer which support the interconnecting circuit paths thereof;

providing an opening in the sidewalls of each metallic housing contoured to conform substantially with the dielectric portions supporting the interconnecting circuit paths corresponding thereto; and seating the sidewalls of each metallic housing in the removed channels of its corresponding high Q region to make physical contact with the top surface of the ground plane.

8. The method in accordance with claim 7 including the step of providing a periphery for each opening in the sidewalls of a metallic housing dimensionally spaced from its corresponding interconnecting circuit path based on the RF shielding desired.

9. The method in accordance with claim 6 including the steps of enclosing each opening of the bottom surface of the substrate with an individual cover plate having a thickness substantially less than that of the ground plane and a cross-sectional area conforming with the opening corresponding thereto; and forming a seat around the periphery of each opening at the bottom surface of the ground plane contoured to accommodate said individual cover plate associated therewith.

10. The method in accordance with claim 9 including the step of dimensioning each removed section of ground plane and associated cover plate to form an air separation, between the walls of the formed lower ground plane and the microstrip circuitry of the corresponding high Q region, which is based on the RF impedance desired.

11. The method in accordance with claim 6 including the step of dimensioning the metallic housing to form an air separation between the walls thereof and the microstrip circuitry it covers based on the RF impedance desired for the corresponding high Q region.

* * * * *